US012698728B2

(12) United States Patent
Meeder

(10) Patent No.: US 12,698,728 B2
(45) Date of Patent: Aug. 4, 2026

(54) REGOLITH HEATING AND HYDROLOX FUEL PRODUCTION VIA ENERGY FROM A NUCLEAR POWERED BRAYTON CYCLE

(71) Applicant: Blue Origin Manufacturing, LLC, Huntsville, AL (US)

(72) Inventor: Matthew P. Meeder, Melbourne, FL (US)

(73) Assignee: Blue Origin Manufacturing, LLC, Huntsville, AL (US)

( * ) Notice: Subject to any disclaimer, the term of this patent is extended or adjusted under 35 U.S.C. 154(b) by 123 days.

(21) Appl. No.: 18/908,705

(22) Filed: Oct. 7, 2024

(65) Prior Publication Data

US 2026/0098488 A1 Apr. 9, 2026

(51) Int. Cl.
*F01K 23/06* (2006.01)
*C25B 1/04* (2021.01)

(52) U.S. Cl.
CPC ..... *F01K 23/064* (2013.01); *C25B 1/04* (2013.01)

(58) Field of Classification Search
CPC ..... F01K 23/064; F01K 3/181; C25B 1/04; G21D 5/00; G21D 5/08; F28D 2021/0045; F28D 2021/0054; F28D 2021/0057
See application file for complete search history.

(56) References Cited

U.S. PATENT DOCUMENTS 4,938,946 A * 7/1990 Gibson ..... B01J 8/28 23/293 R
5,090,195 A * 2/1992 Boily ..... F02K 99/00 60/203.1
11,069,453 B1 * 7/2021 El-Genk ..... G21C 11/00
12,044,126 B1 * 7/2024 Salvino ..... E21C 51/00
12,091,973 B1 * 9/2024 Salvino ..... B64G 1/16
2024/0035379 A1 * 2/2024 Grillos, II ..... E21C 51/00
2024/0110289 A1 * 4/2024 Tanaka ..... C25B 15/08
2025/0299842 A1 * 9/2025 Boudreault ..... G21C 1/30
2026/0049552 A1 * 2/2026 Salvino ..... B64G 1/1071
2026/0063035 A1 * 3/2026 Plaza ..... E21C 51/00

OTHER PUBLICATIONS

"District Heating Supply from Nuclear Power Plants." www.powermag.com. Accessed Jun. 6, 2024. https://www.powermag.com/district-heating-supply-from-nuclear-power-plants/.

Barnert , H. Barnert, V. Krett, and J. Kupitz, "Nuclear energy for heat applications" Topical Reports IAEA Bulletin Jan. 1991, pp. 21-24.

* cited by examiner

*Primary Examiner* — Travis Ruby
(74) *Attorney, Agent, or Firm* — Summit Patents, PC

(57) ABSTRACT

A system powered by a nuclear reactor to heat regolith, extract water from the regolith, perform electrolysis on the water to produce hydrogen and oxygen, and liquify the hydrogen and oxygen to produce fuel is presented. For example, among other possible celestial bodies, the regolith may be lunar regolith and the system may operate on the Moon to perform these activities on the Moon. The system may operate in a permanent shadow region of the Moon, such as at the bottom of a crater, where water-ice is present. In such regions, solar energy may not be available and thus a nuclear reactor provides a benefit in that it operates independently of solar illumination. Another benefit is that the primary loop of a nuclear reactor carries heat that may be used to heat regolith.

20 Claims, 6 Drawing Sheets

REGOLITH HEATING AND HYDROLOX FUEL PRODUCTION VIA ENERGY FROM A NUCLEAR POWERED BRAYTON CYCLE

BACKGROUND

Some of the key challenges of space travel, lunar colonization, and other related activities are the cost and logistics of transporting materials from Earth to the Moon or Space. This is particularly true for fuels such as cryogenic propellant fuels like liquid oxygen and liquid hydrogen. To overcome this, scientists and engineers have been exploring the concept of in-situ resource utilization (ISRU), which involves using materials found on the Moon to build infrastructure, produce fuel, and sustain life.

The Moon's surface, or regolith, is rich in resources such as iron, aluminum, silicon, oxygen, and water (ice). These materials may be extracted and processed to construct various things such as habitats, structures, solar panels, manufacturing equipment, and so on. Accordingly, research continues to concentrate on techniques for utilizing lunar resources.

BRIEF DESCRIPTION OF THE DRAWINGS

The disclosure will be understood more fully from the detailed description given below and from the accompanying figures of embodiments of the disclosure. The figures are used to provide knowledge and understanding of embodiments of the disclosure and do not limit the scope of the disclosure to these specific embodiments. Furthermore, the figures are not necessarily drawn to scale.

DETAILED DESCRIPTION

Figure 1:
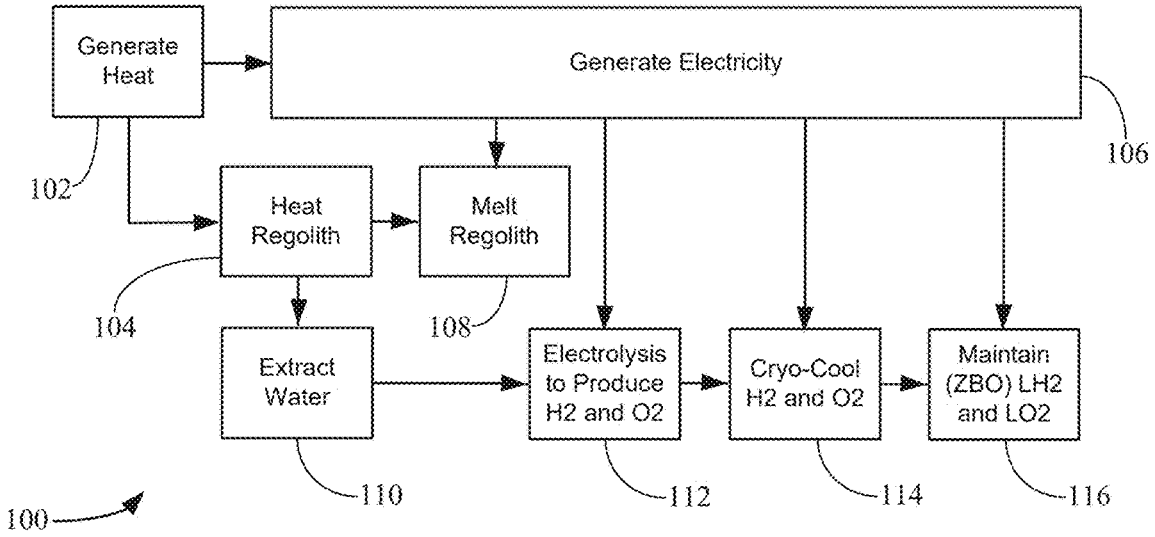
FIG. 1 is a flow diagram of a system for processing and producing various materials, according to some embodiments.

This disclosure describes a system that may be powered by a nuclear reactor to heat regolith, extract water from the regolith, perform electrolysis on the water to produce hydrogen and oxygen, and liquify the hydrogen and oxygen to produce fuel. For example, the regolith may be lunar regolith and the system may operate on the Moon to perform these activities on the Moon. In some implementations, the system may operate in a permanent shadow region of the Moon, such as at the bottom of a crater, where water-ice is present. In such regions, solar energy may not be available and thus a nuclear reactor provides a benefit in that it operates independently of solar illumination. Another benefit is that the primary loop of a nuclear reactor carries heat that may be used to heat regolith, as explained in descriptions below of the system.

As mentioned above, the system may heat, and even melt, regolith. Such heated and melted regolith may be processed by molten oxide electrolysis (MOE), which is a technique for the production of various materials (e.g., oxygen, silicon, and metals) for ISRU. MOE is a process that may be used to reduce molten oxides to their metal form using an electric current. For example, MOE may be used as an electrometallurgical technique to produce iron metal in a liquid state from oxide feedstock. Lunar regolith, which may be used as the feedstock for MOE, generally requires high temperatures (e.g., approximately 1900° C.) to keep the regolith molten and flowing. Generally, extracting resources from the regolith is very energy intensive and extraction processes require a lot of heat. Therefore, utilizing heat from a nuclear reactor to preheat the regolith prior to ISRU processing can greatly reduce the electrical load of such processing actions.

In part of the process of heating regolith, the system described herein may extract water from the regolith. Extraction of water from materials of the Moon could allow for human life support and propellant production on the Moon. Water has been discovered to be in the lunar regolith. Simple and cost-effective extraction of water, and subsequent electrolyzing for fuel production, which may be an ability of the system, could enable the development of a fuel depot on the Moon. The resulting fuel could have commercial, military, and scientific uses. The efficient extraction of water could permit the return of spacecrafts from various planetary bodies without having to launch the return fuel from Earth, with its larger gravity and launch fuel costs, for example.

Thus, among other things such as heating regolith for an MOE process, this disclosure describes techniques and systems for extracting water from lunar regolith, and also for producing fuel from the extracted water. In some embodiments, a system extracts water from lunar regions that are permanently shadowed, which is a condition that can maintain water in its solid phase. The system can distill water vapor extracted from heated regolith before the water vapor is condensed and processed by electrolysis to separate the water into oxygen and hydrogen gases, which are then cooled to form liquid oxygen and liquid hydrogen, respectively.

In some embodiments, a regolith heating system may include a nuclear reactor and a primary loop that carries a heat transport fluid through, and to be heated by, the nuclear reactor. The system may also include a regolith conveyance tube (e.g., one or more) to carry regolith therein, and a heat exchanger configured to transfer heat from the heat transport fluid in the primary loop to the regolith in the regolith conveyance tube. In some implementations, the system may further include a primary-to-secondary loop heat exchanger that is configured to transfer heat from the heat transport fluid in the primary loop to a second heat transport fluid in a secondary loop, which may be a Brayton cycle loop.

The primary loop may include i) a hot side wherein the heat transport fluid travels from the nuclear reactor to the primary-to-secondary loop heat exchanger, and ii) a cold side wherein the heat transport fluid travels from the primary-to-secondary loop heat exchanger to the nuclear reactor. This being the case, the heat exchanger may be considered to be a first heat exchanger that is configured to transfer heat from the heat transport fluid in the cold side of the primary loop to the regolith in the regolith conveyance tube. The system may then further include a second heat exchanger configured to transfer heat from the heat transport fluid in the hot side of the primary loop to the regolith in the regolith conveyance tube. Even though terms such as "hot" and "cold" are used herein regarding the primary loop, it is likely that the heat transport fluid in all parts of the primary loop are at elevated temperatures and the terms "hot" and "cold" are merely relative terms.

In various implementations, the system may further include an electric heating system configured to further heat the heated regolith that exits the heat exchanger and, in the Brayton cycle loop, a regolith hopper configured to receive heat from the Brayton cycle loop. The heat received by the regolith hopper may heat regolith in the regolith hopper so as to vaporize water in the regolith. The regolith hopper may include a portal to provide a path for the vaporized water to exit the regolith hopper. Meanwhile, the regolith hopper is configured to provide "preheated" regolith to the heat exchanger via the regolith conveyance tube for further heating.

In various implementations, the system may further include, in the Brayton cycle loop, an alternator to generate electricity for electrolysis of water, which may be condensed water of the vaporized water from the regolith hopper.

In some embodiments, a method for heating regolith may include heating a heat transport fluid in a primary loop of a nuclear reactor, carrying regolith in a regolith conveyance tube through a heat exchanger that includes a portion of the primary loop, and allowing the heat exchanger to transfer heat from the heat transport fluid in the primary loop to the regolith in the regolith conveyance tube. A primary-to-secondary loop heat exchanger may be used to transfer heat from the heat transport fluid in the primary loop to a second heat transport fluid in a Brayton cycle loop.

The primary loop may include i) a hot side wherein the heat transport fluid travels from the nuclear reactor to the primary-to-secondary loop heat exchanger and ii) a cold side wherein the heat transport fluid travels from the primary-to-secondary loop heat exchanger to the nuclear reactor. The heat exchanger may be considered to be a first heat exchanger that is configured to transfer heat from the heat transport fluid in the cold side of the primary loop to the regolith in the regolith conveyance tube. Accordingly, the method may further include transferring heat, using a second heat exchanger, from the heat transport fluid in the hot side of the primary loop to the regolith in the regolith conveyance tube.

In some implementations, an electric heating system may be used to further heat the heated regolith that exits the heat exchanger. Also, in various implementations, the method may include providing heat from the Brayton cycle loop to a regolith hopper that contains regolith, vaporizing water in the regolith using the heat received by the regolith hopper, providing the regolith to the heat exchanger via the regolith conveyance tube from the regolith hopper, and using an alternator in the Brayton cycle loop to generate electricity for, among other things, electrolysis of the water.

FIG. 1 is a flow diagram of a system 100 for processing and producing various materials, according to some embodiments. For example, among other things, system 100 may be used to produce various regolith-based materials, extract water from regolith (e.g., lunar regolith), and produce fuel from the extracted water. System 100 may be powered by a nuclear reactor to heat regolith, extract water from the regolith, perform electrolysis on the water to produce hydrogen and oxygen, and liquify the hydrogen and oxygen to produce fuel. For example, the nuclear reactor may generate heat at functional block 102. The heat may be used to heat regolith at functional block 104 and generate electricity at functional block 106. The heated regolith may be further heated, and melted, at functional block 108 using, for example, electricity generated at functional block 106. As mentioned above, the heated and melted regolith may be processed by MOE, which is a technique for the production of various materials (e.g., oxygen, silicon, and metals) for ISRU.

Part of the regolith heating at functional block 104 may lead to, at functional block 110, extracting water from the regolith. Electricity generated at functional block 106 may be used to, at functional block 112, perform electrolysis on the extracted water and to liquify, at functional block 114, the hydrogen and oxygen produced by the electrolysis. Electricity generated at functional block 106 may also be used to, at functional block 116, maintain the liquid hydrogen and liquid oxygen in their liquid states, such as with zero-boiloff conditions, for example. As indicated above, the liquid hydrogen and liquid oxygen may be stored and used for fuel or other uses.

Figure 2:
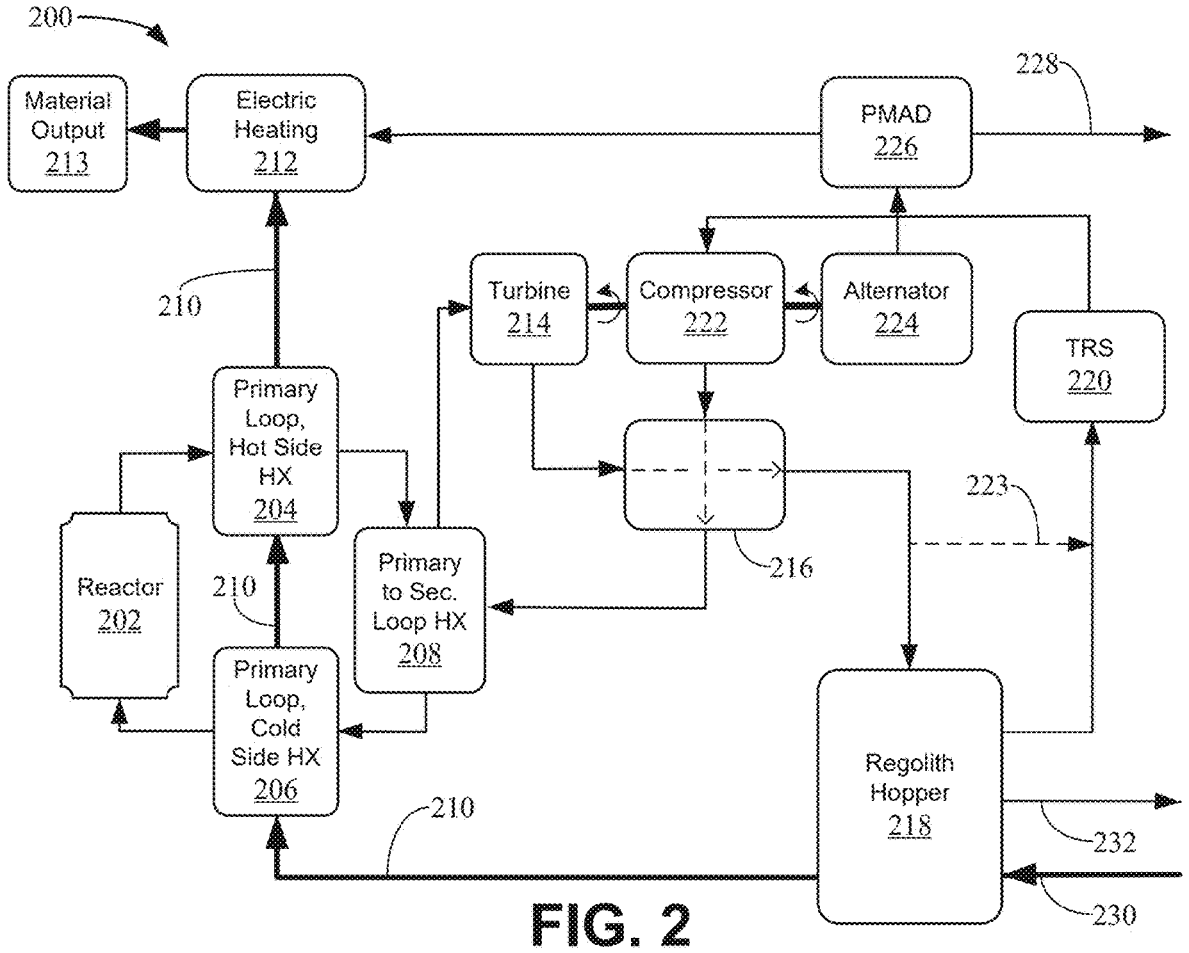
FIG. 2 is a flow diagram of a system for heating regolith, according to some embodiments.

FIG. 2 is a flow diagram of a system 200 for, among other things, heating regolith, according to some embodiments. Though claimed subject matter is not limited in this respect, the regolith may be lunar regolith and system 200 may operate on the Moon. In view of system 100, described above, system 200 may include functional blocks 102, 104, 106, 108, and 110.

System 200 may include a nuclear reactor 202 that is cooled as it provides heat to a primary loop carrying a heat transport fluid therein. The primary loop may include a hot side heat exchanger 204 and a cold side heat exchanger 206. A primary-to-secondary (PS) loop heat exchanger 208 functionally separates hot side heat exchanger 204 and cold side heat exchanger 206. Note that "hot" and "cold" are relative terms used here. For example, heat lost from the (heat transport fluid in the) primary loop via PS loop heat exchanger 208 may result in the temperature of cold side heat exchanger 206 being lower than that of hot side heat exchanger 204. These temperature changes result from the flow direction of the heat transport fluid, which travels from nuclear reactor 202, to hot side heat exchanger 204, to PS loop heat exchanger 208, to cold side heat exchanger 206, and back to the nuclear reactor. This flow may be cyclic and thus repeat.

A regolith conveyance tube 210 may be configured to transport regolith sequentially through cold side heat exchanger 206 and hot side heat exchanger 204. Thermal insulation may be placed to avoid or reduce heat transfer between the cold and hot sides. In other words, regolith being transported in regolith conveyance tube 210 may encounter cold side heat exchanger 206 before encountering hot side heat exchanger 204. As described below, this sequence allows for the temperature of the regolith to increase in steps toward a target temperature. In some implementations, regolith that is output from the hot side heat exchanger 204 may be further heated by an electric heating system 212. In this way, a material output 213 may be melted regolith that can be processed in a variety of ways, such as by MOE, as mentioned above. In some implementations, the regolith transported in regolith conveyance tube 210 may be granulated, crushed, powdered, or other solid form that is transportable in tubing, piping, or other type of conveyance technique (e.g., regolith conveyance tube 210 need not be a "tube"). The flow of the regolith through regolith conveyance tube 210 may be driven by gravity or other externally applied force, for example.

PS loop heat exchanger 208 may be configured to transfer heat from the heat transport fluid in the primary loop to a Brayton cycle loop, which includes a turbine 214, a recuperator 216, a regolith hopper 218, a thermal recovery system (TRS) 220, and a compressor 222. In some implementations, a bypass line 223 may allow a flow of working fluid to bypass regolith hopper 218. A working fluid, which may be supercritical CO2 or a mixture of helium and xenon gas, may flow through the Brayton cycle loop. For example, in sequence, the working fluid that is heated at PS loop heat exchanger 208 flows through turbine 214, through recuperator 216, through regolith hopper 218, through TRS 220, and through compressor 222, from where the working fluid returns to the PS loop heat exchanger. This flow may then repeat cyclically. The transiting working fluid turns turbine 214 to provide mechanical power to compressor 222 and also turns the rotor of an alternator 224 to generate electricity, which is provided to a power management and distribution (PMAD) system 226. In some implementations, a shaft of turbine 214 may be common to both compressor 222 and alternator 224 and thus the shaft provides the mechanical power to both the compressor and the alternator. In some implementations, PMAD system 226 provides electrical power to electric heating system 212 and other systems, described below, via a path 228.

After passing through turbine 214, the working fluid passes through recuperator 216 where heat from the working fluid in this part of the Brayton cycle loop is transferred to the working fluid exiting compressor 222. In general terms, a recuperator, such as 216, is a type of heat exchanger having separate flow paths for the working fluid to be cooled in one path while the working fluid in the other path is heated, wherein heat is transferred through walls separating the two fluid paths. The fluids, which are the same in both flow paths (e.g., in a closed loop system), may be gas, liquid, or a combination thereof. In some embodiments, such a heat exchange system may include a cylindrical shell that is configured to contain the working fluid, for example. Opposing flows of the fluid exchange heat with each other as they pass through the recuperator via a series of midplates and microtubes inside the shell. Thus, in this case, for example, heat from the working fluid exiting turbine 214 may be transferred, via recuperator 216, to the working fluid exiting compressor 222.

After the recuperator, the working fluid flows to regolith hopper 218, which may be configured to be provided by regolith via an input port 230, which may be an airlock-style port or door to keep the moisture inside the regolith hopper during regolith filling events. Regolith hopper 218 may also include tubing that carries the working fluid exiting recuperator 216 through regolith that at least partially fills the regolith hopper. As described below, the tubing may allow for a transfer of heat from the working fluid in the Brayton cycle loop to the regolith so as to heat the regolith. Such heating, in addition to "preheating" the regolith, may result in an extraction of water from the regolith. For example, the heat received by regolith hopper 218 may heat regolith in the regolith hopper so as to vaporize water in the regolith. The regolith hopper may include a portal to provide a path 232 for the vaporized water to exit the regolith hopper. Meanwhile, the regolith hopper may be configured to provide the preheated regolith to cold side heat exchanger 206 and hot side heat exchanger 204 via regolith conveyance tube 210.

In some implementations, TRS 220 may, after receiving the working fluid from the tubing inside regolith hopper 218, cool the working fluid before the working fluid flows into compressor 222. The heat energy given up at TRS 220 may be utilized by one or more processes or may be considered waste heat that is given up to the surrounding environment.

Figure 3:
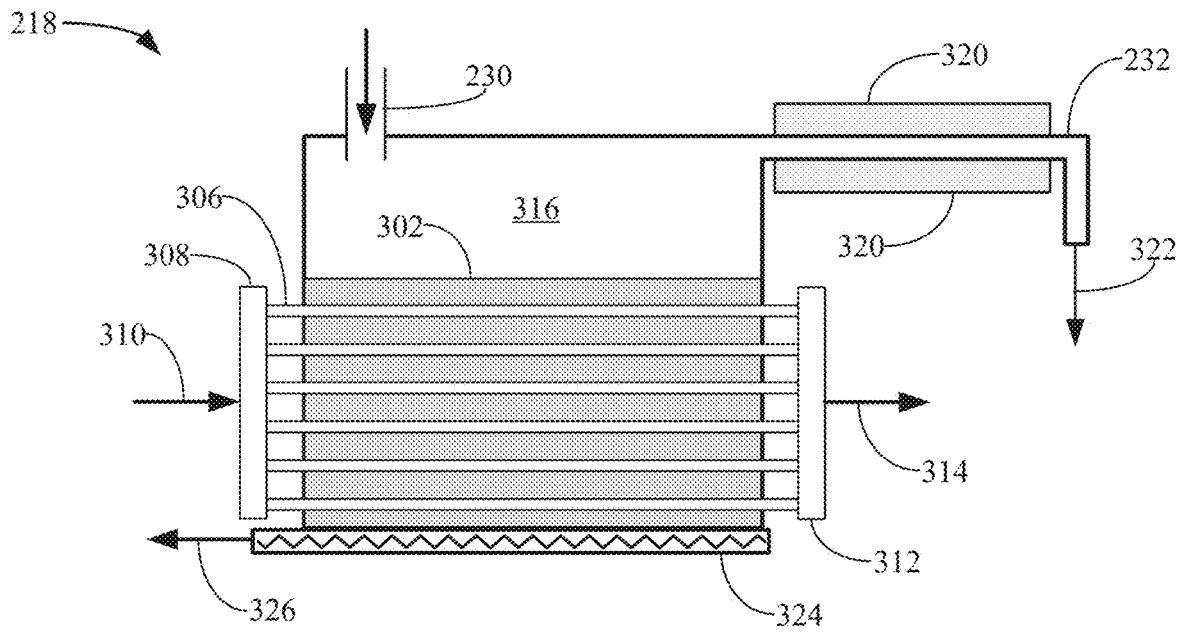
FIG. 3 is a schematic cross-section view illustrating a regolith hopper, according to some embodiments.

FIG. 3 is a schematic cross-section view illustrating regolith hopper 218, according to some embodiments. Regolith hopper 218 may comprise a chamber to hold regolith 302 that is received via an input port 230. In some implementations, a number of tubes 306 may transit across and through regolith 302 inside the chamber. Tubes 306 may carry the working fluid of the Brayton loop cycle described above. In particular, a fluid distribution chamber 308 may receive the working fluid from recuperator 216, as indicated by arrow 310. The working fluid may be collected at the other end of tubes 306 by a collection chamber 312, which may then provide the working fluid to TRS 220, as indicated by arrow 314. As the relatively hot working fluid transits tubes 306 in regolith 302, it heats the regolith. The amount of heating may be sufficient to vaporize water that is otherwise held in the regolith in the form of ice. The vaporized water may then rise to a region 316 in the chamber above regolith 302 and exit the chamber via path 232. In some implementations, path 232 may be at least partially surrounded by a condenser system 320 that cools the water vapor into liquid water, which exits regolith hopper 218, as indicated by arrow 322, to be stored and/or used to make fuel, as described below. Condenser system 320 may comprise cooling fins of a thermal recovery system to radiate heat from the water vapor.

Regolith 302 warmed by the heat received from the Brayton cycle loop, via tubes 306, may exit regolith hopper 218 by a conveyor outlet 324. From this point the regolith may be conveyed to cold side heat exchanger 206 and hot side heat exchanger 204 via regolith conveyance tube 210, as indicated by arrow 326.

In some implementations, input port 230 and conveyor outlet 324 may be configured so that water vapor extracted from regolith 302 in the chamber of regolith hopper 218 cannot escape from the chamber through the input port and conveyor outlet. Accordingly, the only exit for the water vapor is via exit 232, for example. In some cases, the input port and conveyor outlet may include an airlock-type configuration.

Figure 4:
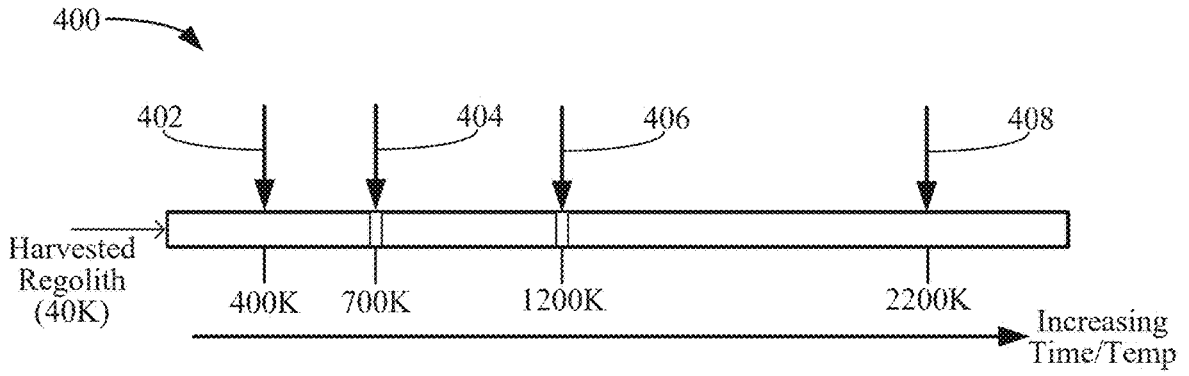
FIG. 4 is a schematic representation of the thermal evolution of regolith as it transits a nuclear-powered system, according to some embodiments.

FIG. 4 is a schematic representation 400 of the thermal evolution of regolith as it transits a nuclear-powered system, such as system 200, according to some embodiments. Referring to FIGS. 2 and 3, regolith enters regolith hopper 218 where it is heated (e.g., preheated). Then the regolith enters cold side heat exchanger 206 where it is further heated. Then the regolith enters hot side heat exchanger 204 where it is again further heated. Then the regolith enters into electric heating system 212 where it may be further heated and melted. Representation 400 graphically describes this thermal evolution of the regolith for a particular example. Starting at the left of 400, regolith may begin at a temperature that is the same as or similar to temperatures of permanently shadowed areas of the Moon, such as the bottom of polar craters. These areas may be chosen to operate system 200 because the regolith in such areas may likely contain water-ice for the system to extract from the regolith. Accordingly, the temperature of regolith that is harvested from these areas may be about 40K (Kelvin), just to give a particular example. The 40K regolith is harvested and supplied to regolith hopper 218 via an airlock style input port 230. Heat 402 from tubes 306 may heat the regolith up to about 400K to vaporize any water from the regolith and convert it into water vapor. This heated regolith may then exit regolith hopper 218 via conveyor outlet 324 and pass into cold side heat exchanger 206 that supplies heat 404 to the regolith. Heat 404 may raise the temperature of the regolith to about 700K. This regolith may then pass into hot side heat exchanger 204, which adds heat 406 to the regolith to increase the regolith temperature to about 1200K. In some implementations, the regolith may be provided into electric heating system 212 to further heat and melt the regolith with heat 408 generated by electric coils, microwaves or other heat sources.

Figure 5A:
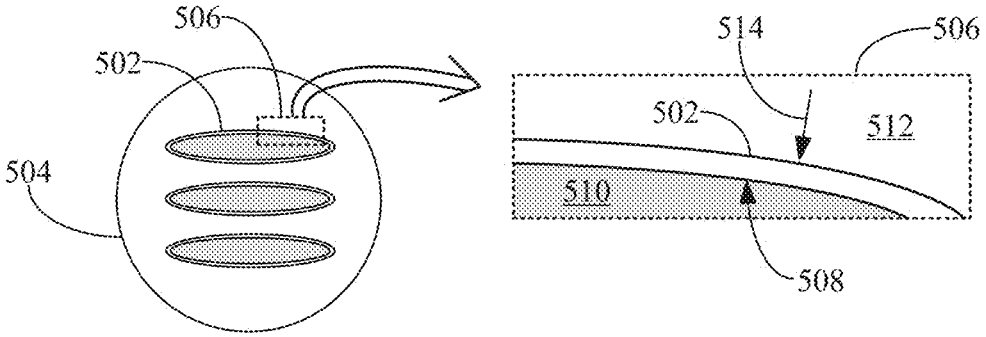
FIG. 5A is a schematic cross-section view illustrating regolith conveyance tubes immersed in a channel of a primary loop of a nuclear reactor, according to some embodiments.

FIG. 5 is a schematic cross-section view illustrating regolith conveyance tubes 502 immersed in a channel 504 of a primary loop of a nuclear reactor, according to some embodiments. For example, the primary loop may be that of nuclear reactor 202. Channel 504 may be a portion of the primary loop in hot side heat exchanger 204 or cold side heat exchanger 206. The elliptical cross-section shape of regolith conveyance tube 502 may allow for, as compared to a circular cross-section, increased surface area for heat transfer through the tube shell while maintaining a relatively low resistance (e.g., low pressure drop) to flow of the solid regolith inside the regolith conveyance tube(s). Also, the elliptical shape leads to the center of the regolith flow being relatively close to the sides of the regolith conveyance tube. These ideas are illustrated in inset 506, which shows a close-up view of the regolith conveyance tube material between the outer surface of regolith conveyance tube 502 and an inner surface 508 of the regolith conveyance tube. Regolith 510 may be inside regolith conveyance tube 502 and flowing in or out of the view. A heat transport fluid 512 that flows through the primary loop of the nuclear reactor, whether in the portion of the primary loop in hot side heat exchanger 204 or cold side heat exchanger 206, may be hotter than regolith 510. Thus, heat will flow, as indicated by arrow 514, from outside regolith conveyance tube 502 through the tube material and to inside the regolith conveyance tube to heat up regolith 510. For at least the reason that all parts of regolith 510 are relatively close to inner surface 508, the elliptical cross-section shape of the regolith conveyance tube(s) allows for relatively efficient heat transfer to the regolith from the heat transport fluid that is just outside the regolith conveyance tubes. In contrast, a circular cross-section would have the center of flow of regolith being thermally insulated from the sides of the regolith conveyance tube by the regolith itself having a thickness being the radius of the regolith conveyance tube.

Figure 5B:
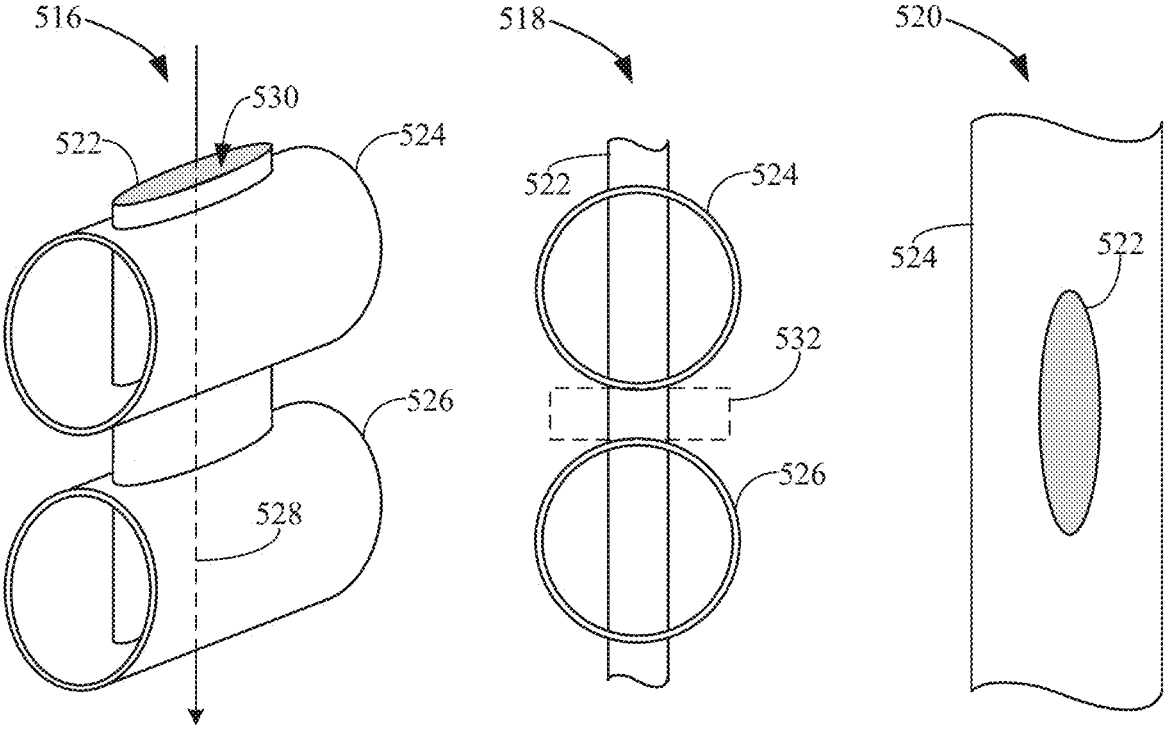
FIG. 5B includes several views of a regolith conveyance tube immersed in channels of primary and secondary loops of a nuclear reactor, according to some embodiments.

FIG. 5B includes several views of a regolith conveyance tube immersed in channels of primary and secondary loops of a nuclear reactor, according to some embodiments. View 516 is a perspective view, view 518 is a cross-section side view, and view 520 is a cross-section top view. A regolith conveyance tube 522 is immersed in both a cool-side channel 524 and a hot-side channel 526 of a primary loop of a nuclear reactor. And arrow 528 indicates the direction of flow of the regolith on the inside 530 of tube 522. This configuration may be the same as or similar to that illustrated in FIG. 2, where the primary loop includes hot side heat exchanger 204 and cold side heat exchanger 206. Accordingly, cool-side channel 524 may be in cold side heat exchanger 206 and hot-side channel 526 may be in hot-side channel 526. As mentioned above, "hot" and "cold" are relative terms as used here. In some implementations, thermal insulation 532 may be between cool-side channel 524 and hot-side channel 526 to reduce or prevent heat transfer between the two channels.

Figure 6:
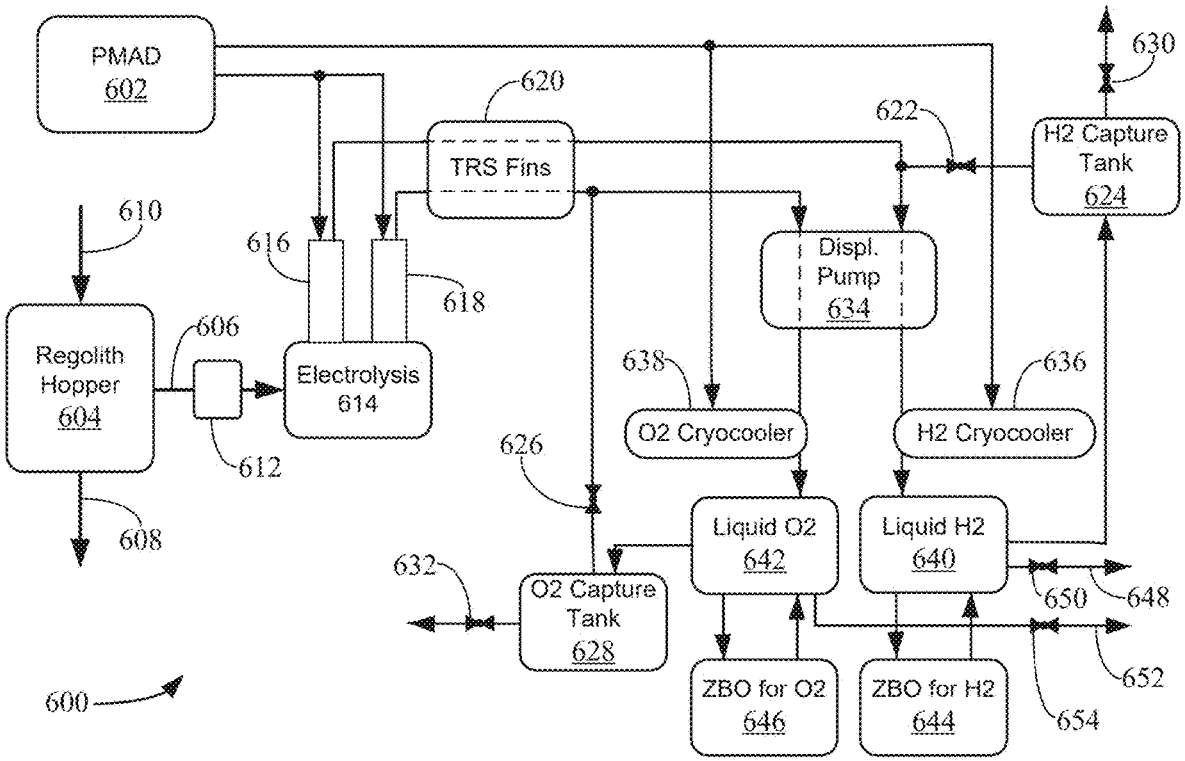
FIG. 6 is a flow diagram of a system for producing liquid oxygen and liquid hydrogen from water extracted from regolith, according to some embodiments.

FIG. 6 is a flow diagram of a system 600 for producing liquid oxygen and liquid hydrogen from water extracted from regolith, according to some embodiments. Though claimed subject matter is not limited in this respect, the regolith may be lunar regolith and system 600 may operate on the Moon. In view of system 100, described above, system 600 may include functional blocks 110, 112, 114, 116, 108, and electricity generated at functional block 106. In other words, system 600 may involve i) extracting water from regolith (e.g., functional block 110), ii) electricity generated at functional block 106 for electrolysis on the extracted water (e.g., functional block 112), iii) hydrogen and oxygen liquification (e.g., functional block 114, and iv) maintaining the liquid hydrogen and liquid oxygen at zero-boiloff conditions (e.g., functional block 116).

System 600 may comprise a portion of system 200, such as PMAD 226 and regolith hopper 218, for example. In particular, a PMAD system 602 may be the same as or similar to PMAD system 226 of system 200 and may provide electrical power to system 600 via path 228. Likewise, a regolith hopper 604 may be the same as or similar to regolith hopper 218 of system 200 and may provide vaporized water to system 600 via a path 606 (e.g., 232). Moreover, regolith hopper 604 may provide preheated regolith, via a regolith conveyance tube 608 (e.g., 210), to cold side heat exchanger 206 and hot side heat exchanger 204. Regolith hopper 604 may receive regolith via an input port 610 (e.g., 230).

System 600 may include a condenser system 612 (e.g., 320) that receives vaporized water from regolith hopper 604 via path 606 and cools the vaporized water into liquid water, which is then provided to an electrolysis system 614. Electricity provided by PMAD 602 may be used to energize an electrolysis process to separate the liquid water into its component hydrogen (H2) and oxygen (O2), each respectively collected into an H2 gas collector 616 from the cathode side of the electrolysis and an O2 gas collector 618 from the anode side. Both the H2 and O2 gases may be cooled as these gases pass through a TRS 620 which, in some implementations, may cool the gases from about 370K to 140K, though claimed subject matter is not limited to such numeric examples that are provided herein.

An H2 capture tank 624 may be used to capture excess gas from H2 gas collector 616 and an O2 capture tank 628 may be used to capture excess gas from O2 gas collector 618. These capture tanks, however, may be primarily used to collect boiloff from an H2 tank 640 and an O2 tank 642, respectively. In some implementations, while electrolysis 614 is not being operated, valves 622 and 626 may be opened to bring H2 and O2 gas back to a displacement pump 634 to reliquefy the boiloff gas. Venting valves 630 and 632 may be used as emergency system relief valves, though a general goal may be to avoid expelling (e.g., wasting) propellant.

Other portions of the H2 and the O2 that exit TRS 620 may be provided to displacement pump 634 that may be configured to draw these gases through TRS 620 and compress the gases into an H2 cryocooler 636 and an O2 cryocooler 638, respectively. The cryocoolers may liquify the H2 and the O2, which may be collected and stored in H2 tank 640 and O2 tank 642, respectively.

In space or on the Moon, long duration missions or habitation generally require a capability to store and maintain cryogenic propellants for an extended period of time. Cryogenic propellants, such as liquid oxygen and liquid hydrogen, are relatively difficult to maintain due to heating from external sources, whether in space or on the Moon, which causes these propellants to boil off. Storing cryogenic propellants in a permanently shadowed part of the Moon may be highly beneficial. In addition to judicious selection of a storage location, a heat exchange system may be used to keep such propellants cool and in their liquid state. More ideally, a zero-boiloff (ZBO) approach, which would likely involve extremely efficient heat exchangers, would allow for long-term, no-loss storage of cryogenic propellants, which is an important goal for lunar and Martian operations and space flight in general. For example, zero-boiloff storage would allow for efficient extraction and storage operations of hydrogen and oxygen from lunar resources, as described above for system 600. Accordingly, ZBO processes may be applied to the H2 in tank 640 and the O2 in tank 642. For example, a ZBO system 644 may be used to maintain the H2 in tank 640 at cryogenic temperatures and a ZBO system 646 may be used to maintain the O2 in tank 642 at cryogenic temperatures. General principles of such ZBO systems are described below. Claimed subject matter, however, is not limited to the ideal goal of zero-boiloff, and ZBO systems 644 and 646 may only approximately achieve this ideal goal by maintaining the H2 in tank 640 and the O2 in tank 642 at cryogenic temperatures with some loss.

In various implementations, hydrogen gas (e.g., from boiloff) in H2 tank 640 may be collected at H2 capture tank 624. Liquid hydrogen in H2 tank 640 may be provided, via a path 648 and a valve 650, to a long-term fuel storage facility, for example, or other end users. Similarly, oxygen gas (e.g., from boiloff) in O2 tank 642 may be collected at O2 capture tank 628. Liquid oxygen in O2 tank 642 may be provided, via a path 652 and a valve 654, to the long-term fuel storage facility, for example, or other end users.

Figure 7:
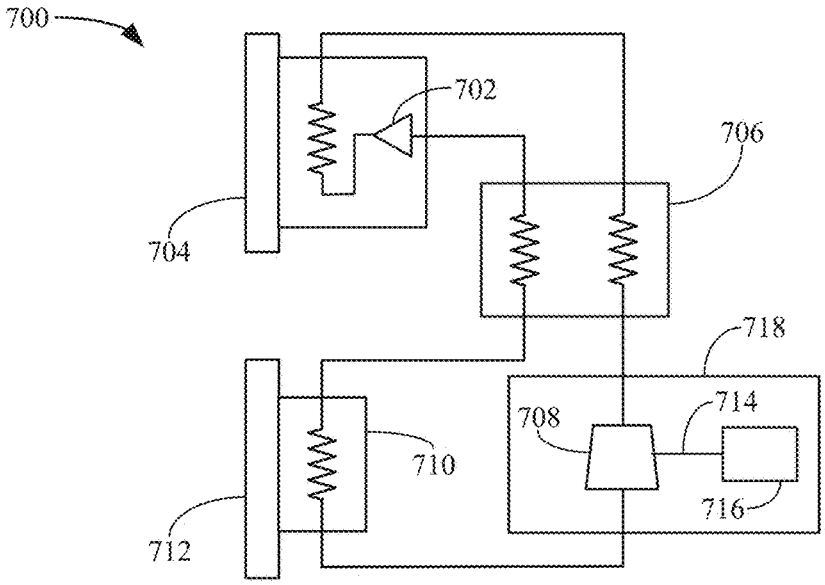
FIG. 7 is a schematic representation of a reverse-Brayton cycle cryocooler, according to some embodiments.

FIG. 7 is a schematic representation of a reverse-Brayton cycle cryocooler 700, according to some embodiments. The cryocooler, or a similar system, may be used for ZBO processes, such as those of ZBO systems 644 and 646, for example. Refrigeration systems that operate below 120 K are commonly referred to as cryocoolers. There are several different types of cryocoolers that can be broadly categorized, such as recuperative (Joule-Thompson and Brayton) and regenerative (Gifford-McMahon, Stirling, pulse tube) cycles, for example. In reverse-Brayton cryocoolers, gas is compressed and expanded in turbomachinery. A Brayton cryocooler includes a compressor to pressurize a working gas, such as helium, which is cooled through a heat exchanger to reject heat to the environment. Next, the gas flows through a recuperator to precool the gas to a temperature close to the desired cooling temperature. The purpose of this precooling is to reduce the load on the refrigeration in a turbine of the cryocooler, thus increasing system efficiency. Next, the gas expands through the turbine, further dropping in temperature. The turbine exit is the coldest point in the cycle. The gas can subsequently flow through a load and absorb heat at the desired cryogenic temperature, where the gas, typically, warms up a few degrees. The low-pressure cold stream of gas then flows through the recuperator to precool the incoming high-pressure stream before returning to the compressor.

Cryocooler 700 is configured for a working fluid to cyclically flow therethrough. For example, relatively warm working fluid (e.g., helium gas) may enter (e.g., from the right in the figure) a compressor 702 to compress the working fluid. In some implementations, compressor 702 may be a turbo-compressor. The increase in pressure increases the temperature of the working fluid, which is subsequently cooled via a heat sink 704. The working gas leaving the heat sink flows into a recuperator 706, which further cools the working fluid. The working gas leaving the recuperator enters into a turbine 708 that is rotated by the working gas as it expands and gives up pressure. This expansion and concomitant lowering of pressure greatly cools the working fluid to cryogenic temperatures. Thus, the cold working fluid is in a thermal condition to provide refrigeration to a load 710 and is able to cool the load. This process, however, heats the working fluid by absorbing heat from the load via surfaces 712 at the load. The working gas leaving load 710 flows back into recuperator 706 where the working fluid exchanges heat with the working fluid that entered into the recuperator from compressor 702. This heat exchange heats the working fluid flowing toward compressor 702 while cooling the working fluid flowing toward turbine 708.

As described above, the working gas leaving the recuperator enters into turbine 708 and rotates the turbine. This rotation may be translated, via a shaft 714, to an alternator 716 to generate electricity, which may be contributed to the electrical power used to operate the cryocooler. Alternator 716, turbine 708, and shaft 714, among other things, may form a turboalternator 718.

Figure 8:
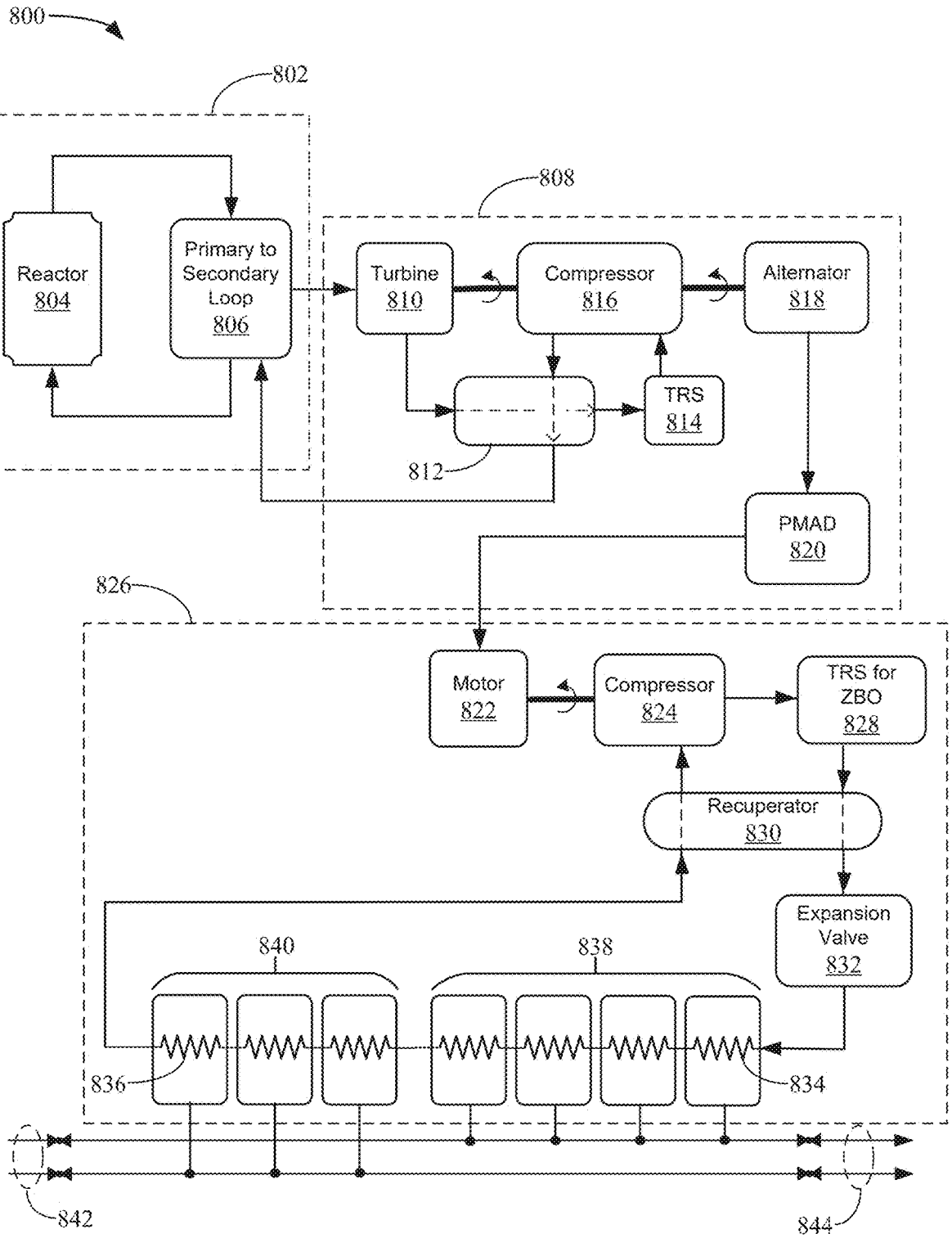
FIG. 8 is a flow diagram of a nuclear-powered system for maintaining liquid oxygen and liquid hydrogen at cryogenic temperatures, according to some embodiments.

FIG. 8 is a flow diagram of a nuclear-powered system 800 for maintaining (e.g., storing) liquid oxygen and liquid hydrogen at cryogenic temperatures, according to some embodiments. In some implementations, various components of system 800 may be common with system 200. For example, a portion 802, which includes a nuclear reactor 804 and a primary-to-secondary (PS) loop heat exchanger 806, may be the same as or similar to the portion of system 200 that includes nuclear reactor 202 and PS loop heat exchanger 208.

Also, a portion 808 of system 800, may comprise a Brayton cycle loop that may be the same as or similar to the Brayton cycle loop of system 200 that includes turbine 214, recuperator 216, regolith hopper 218, TRS 220, and compressor 222, with the exception that portion 808 need not include a regolith hopper. There may be other differences between portion 808 and the Brayton cycle loop of system 200 and their comparison is merely to provide an example of possible implementations of system 800.

In detail, the Brayton cycle loop of portion 808 may include a turbine 810, a recuperator 812, a TRS 814, and a compressor 816. A working fluid, such as supercritical CO2 or a mixture of helium and xenon gas, flows through the Brayton cycle loop in a sequence that begins with the working fluid that is heated at PS loop heat exchanger 806 flowing through turbine 810, through recuperator 812, through TRS 814, and through compressor 816, from where the working fluid returns to the PS loop heat exchanger. The transiting working fluid turns turbine 810 to provide mechanical power to compressor 816 and to turn the rotor of an alternator 818 to generate electricity, which is provided to a power management and distribution (PMAD) system 820. In some implementations, the mechanical power provided to compressor 816 and alternator 818 is by a shaft of turbine 810 that is common to both the compressor and the alternator.

In some implementations, PMAD system 820 provides electrical power to a motor 822 that drives a compressor 824. Interestingly, in some cases, the shaft of turbine 810 that drives compressor 816 may not also drive compressor 824 because design rotation speeds of these compressors may be substantially different from each other. For example, turbine 810 may be configured to drive alternator 818 to generate electricity whereas motor 822 may be configured to drive compressor 824 to pressurize a working fluid in a reverse-Brayton cycle loop 826, as described below. Each of these different functions may involve different compressor speeds, though claimed subject matter is not so limited.

In addition to portion 802, which includes nuclear reactor 804 and PS loop heat exchanger 806, and portion 808, which includes a Brayton cycle loop, system 800 may also include reverse-Brayton cycle loop 826, which includes motor 822, compressor 824, a TRS 828, a recuperator 830, an expansion valve 832, liquid H2 (LH2) tank heat exchangers 834, and liquid O2 (LO2) tank heat exchangers 836. These heat exchangers cool liquid H2 and liquid O2 in hydrogen tanks 838 and oxygen tanks 840, respectively.

In reverse-Brayton cycle loop 826, gas (e.g., a working fluid) is compressed by compressor 824 to pressurize the gas, such as helium, which is cooled through TRS 828 to reject heat to the environment. Next, the gas flows through recuperator 830 to precool the gas to a temperature close to the desired cooling temperature. Next, the gas expands through expansion valve 832 (which may be a turbine in some implementations), further dropping in temperature. The expansion valve exit is the coldest point in the cycle. The gas can subsequently flow through one or more loads, which are LH2 tank heat exchangers 834 and LO2 tank heat exchangers 836, and absorb heat at the desired cryogenic temperature, where the working gas, typically, warms up a few degrees. The low-pressure cold stream of working gas then flows through recuperator 830 to precool the incoming high-pressure gas (from an output of compressor 824) before returning to an input of the compressor.

LH2 tank heat exchangers 834 and LO2 tank heat exchangers 836 may maintain stored LH2 and LO2 in their liquid phase in hydrogen tanks 838 and oxygen tanks 840, respectively. The LH2 and LO2 may be provided to these tanks via input ports 842 from fuel production systems, such as system 600. For example, path 648 of system 600 may provide LH2 to a long-term fuel storage facility, which may comprise LH2 tanks 838. Similarly, path 652 of system 600 may provide LO2 to the long-term fuel storage facility, which may comprise LO2 tanks 840. Each of LH2 tanks 838 and LO2 tanks 840 may subsequently provide their contents, via output ports 844, as needed, to various users, which may be based on the Moon, for example.

Figure 9:
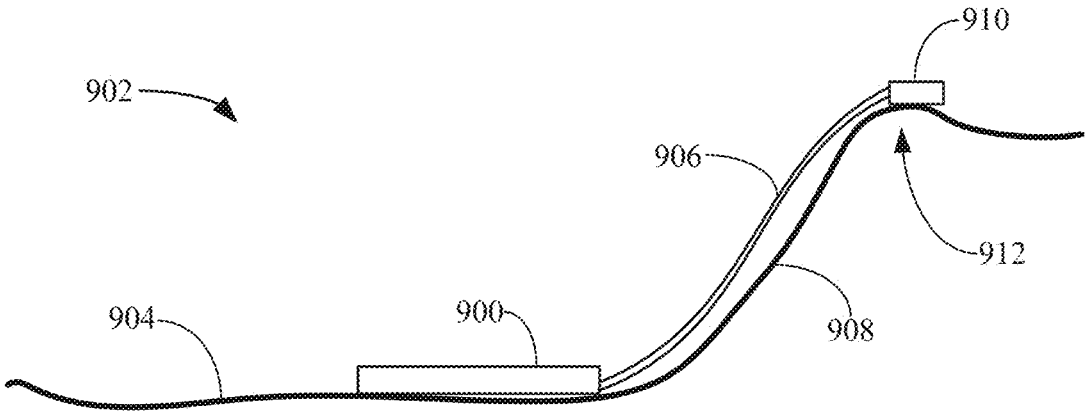
FIG. 9 is a schematic representation of a nuclear-powered fuel producing facility in a crater or other permanently-shadowed area, according to some embodiments.

FIG. 9 is a schematic representation of a nuclear-powered facility 900 for producing and storing fuel in a crater 902 or other permanently-shadowed area, according to some embodiments. For example, facility 900 may include system 200 (e.g., extracting water from regolith), system 600 (e.g., producing LH2 and LO2 from the extracted water), and system 800 (e.g., storing the LH2 and LO2). Being in a permanently-shadowed area, facility 900 may avoid heating from exposure to the Sun. In some implementations, regolith for system 200 may be collected at a location 904 that is different from that of system 200, but such a location would still preferably be in a permanently-shadowed area so that water-ice is present in the regolith. In this particular example, LH2 and LO2 stored in LH2 tanks 838 and LO2 tanks 840, for example, may be transported, via output ports 844 and lines 906, up the side 908 of crater 902 to a lunar base 910 at the edge 912 of the crater.

Figure 10:
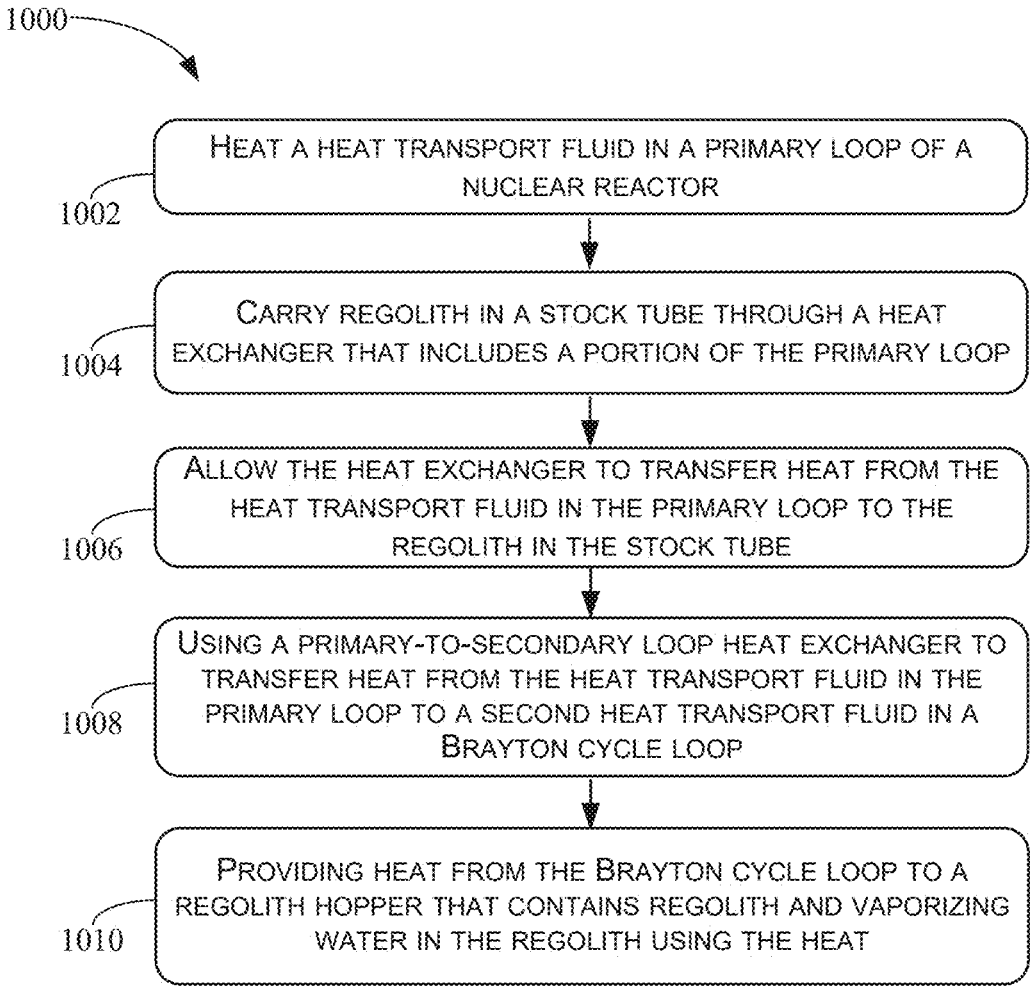
FIG. 10 is a flow diagram of operating a system for heating regolith and extracting water from the regolith, according to some embodiments.

FIG. 10 is a flow diagram of a process 1000 for heating regolith and extracting water from the regolith, according to some embodiments. Process 1000 may be performed locally or remotely by an electronic controller, a computer processing system following computer-executable instructions, an operator such as a person on a space vehicle or at a remote control center, or a combination thereof. For a particular example, process 1000 will be described with reference to system 200, though claimed subject matter is not so limited.

At 1002, the operator may heat a heat transport fluid that flows in the primary loop of nuclear reactor 202. At 1004, the operator may transport regolith in regolith conveyance tube 210 through a heat exchanger, such as 204 and/or 206, that includes a portion of the primary loop. At 1006, the operator may allow, such as by controlling flow speed of the regolith and/or the heat transport fluid, the heat exchanger to transfer heat from the heat transport fluid in the primary loop to the regolith in regolith conveyance tube 210, which traverses the heat exchanger(s). At 1008, the operator may use primary-to-secondary loop heat exchanger 208 to transfer heat from the heat transport fluid in the primary loop to a second heat transport fluid in a Brayton cycle loop. At 1010, the operator may provide heat from the Brayton cycle loop to regolith hopper 218 that contains regolith. This heat may result in the vaporizing of water in the regolith.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific embodiments or examples are presented by way of examples for purposes of illustration and description. They are not intended to be exhaustive of or to limit this disclosure to the precise forms described. Many modifications and variations are possible in view of the above teachings. The embodiments or examples are shown and described in order to best explain the principles of this disclosure and practical applications, to thereby enable others skilled in the art to best utilize this disclosure and various embodiments or examples with various modifications as are suited to the particular use contemplated. It is intended that the scope of this disclosure be defined by the following claims and their equivalents.

I claim as follows:

1. A regolith heating system comprising:

a nuclear reactor;

a primary loop that carries a heat transport fluid through, and to be heated by, the nuclear reactor;

a regolith conveyance tube to carry regolith therein; and a heat exchanger configured to transfer heat from the heat transport fluid in the primary loop to the regolith in the regolith conveyance tube.

2. The regolith heating system of claim 1, further comprising a primary-to-secondary loop heat exchanger that is configured to transfer heat from the heat transport fluid in the primary loop to a second heat transport fluid in a secondary loop.

3. The regolith heating system of claim 2, wherein the primary loop includes i) a hot side wherein the heat transport fluid travels from the nuclear reactor to the primary-to-secondary loop heat exchanger, and ii) a cold side wherein the heat transport fluid travels from the primary-to-secondary loop heat exchanger to the nuclear reactor.

4. The regolith heating system of claim 3, wherein the heat exchanger is a first heat exchanger that is configured to transfer heat from the heat transport fluid in the cold side of the primary loop to the regolith in the regolith conveyance tube, and further comprising a second heat exchanger configured to transfer heat from the heat transport fluid in the hot side of the primary loop to the regolith in the regolith conveyance tube.

5. The regolith heating system of claim 1, further comprising an electric heating system configured to further heat the heated regolith that exits the heat exchanger.

6. The regolith heating system of claim 2, wherein the secondary loop is a Brayton cycle loop.

7. The regolith heating system of claim 6, further comprising, in the Brayton cycle loop, a regolith hopper configured to receive heat from the Brayton cycle loop between the regenerator and Brayton cycle TRS.

8. The regolith heating system of claim 7, wherein the heat received by the regolith hopper heats regolith in the regolith hopper so as to vaporize water in the regolith.

9. The regolith heating system of claim 8, wherein the regolith hopper includes a portal to provide a path for the vaporized water to exit the regolith hopper.

10. The regolith heating system of claim 7, wherein the regolith hopper is configured to provide the regolith to the heat exchanger via the regolith conveyance tube.

11. The regolith heating system of claim 6, further comprising, in the Brayton cycle loop, an alternator to generate electricity for electrolysis of water.

12. The regolith heating system of claim 7, further comprising, in the Brayton cycle loop, an alternator to generate electricity for electrolysis of condensed water of the vaporized water from the regolith hopper.

13. A method for heating regolith, the method comprising:

heating a heat transport fluid in a primary loop of a nuclear reactor;

carrying regolith in a regolith conveyance tube through a heat exchanger that includes a portion of the primary loop; and allowing the heat exchanger to transfer heat from the heat transport fluid in the primary loop to the regolith in the regolith conveyance tube.

14. The method of claim 13, further comprising using a primary-to-secondary loop heat exchanger to transfer heat from the heat transport fluid in the primary loop to a second heat transport fluid in a Brayton cycle loop.

15. The method of claim 14, wherein the primary loop includes i) a hot side wherein the heat transport fluid travels from the nuclear reactor to the primary-to-secondary loop heat exchanger and ii) a cold side wherein the heat transport fluid travels from the primary-to-secondary loop heat exchanger to the nuclear reactor, and the heat exchanger is a first heat exchanger that is configured to transfer heat from the heat transport fluid in the cold side of the primary loop to the regolith in the regolith conveyance tube;

the method further comprising:

transferring heat, using a second heat exchanger, from the heat transport fluid in the hot side of the primary loop to the regolith in the regolith conveyance tube.

16. The method of claim 13, further comprising using an electric heating system to further heat the heated regolith that exits the heat exchanger.

17. The method of claim 14, further comprising providing heat from the Brayton cycle loop to a regolith hopper that contains regolith.

18. The method of claim 17, further comprising vaporizing water in the regolith using the heat received by the regolith hopper.

19. The method of claim 17, further comprising providing the regolith to the heat exchanger via the regolith conveyance tube from the regolith hopper.

20. The method of claim 18, further comprising using an alternator in the Brayton cycle loop to generate electricity for electrolysis of the water.

* * * * *